US005737983A

United States Patent [19]

Rennerfelt

[11] Patent Number: 5,737,983

[45] Date of Patent: Apr. 14, 1998

[54] DYNAMOMETRIC WRENCH

[75] Inventor: Gustav Rennerfelt, Lidingo, Sweden

[73] Assignee: Torque System Sweden AB, Bromma, Sweden

[21] Appl. No.: 718,403

[22] PCT Filed: Mar. 28, 1995

[86] PCT No.: PCT/SE95/00327

§ 371 Date: Sep. 30, 1996

§ 102(e) Date: Sep. 30, 1996

[87] PCT Pub. No.: WO95/26858

PCT Pub. Date: Oct. 12, 1995

[30] Foreign Application Priority Data

Mar. 31, 1994 [SE] Sweden ..... 9401096

[51] Int. Cl.[6] ..... B25B 23/159; B25B 23/144

[52] U.S. Cl. ..... 81/479; 81/477

[58] Field of Search ..... 81/467, 477–483, 81/471

[56] References Cited

U.S. PATENT DOCUMENTS 3,611,796 10/1971 Hayward ..... 81/477 X
3,678,744 7/1972 Blattner .
3,701,295 10/1972 Mende ..... 81/477
4,238,978 12/1980 Leone .
4,838,134 6/1989 Ruland .

FOREIGN PATENT DOCUMENTS 0393852 10/1990 European Pat. Off. .

*Primary Examiner*—D. S. Meislin
*Attorney, Agent, or Firm*—Young & Thompson

[57] ABSTRACT

A dynamometric wrench comprises a handle part (1) and an elongated torsion body (2) which at a first end (3) is co-rotatively connected with the handle part (1) and at the opposite end (4) has means for connecting the torsion body (2) with a screw or similar. In the region of the latter end (4), the torsion body (2) is co-rotatively connected with a socket- or ring-like part (8) which is rotatable relative to the handle part (1) when the body (2) is submitted to torsion due to it being loaded with a torque. A stop element (10) is connected with the handle part (1), which element is arranged to cooperate with at least one shoulder (12') on the socket part (8), more specifically in such a way that the stop element is brought into contact with the shoulder when a predetermined, optimal torque has been applied upon the screw, which torque confers an elastic, but not a plastic distortion to the torsion body.

16 Claims, 3 Drawing Sheets

DYNAMOMETRIC WRENCH

TECHNICAL FIELD OF THE INVENTION

The present invention relates to a dynamometric wrench comprising a manually grippable, handle-forming part and an elongated torsion body, which in the region of a first end is co-rotatively connected with the handle part and in the region of an opposed, second end has means for directly or indirectly joining the torsion body to a screwable element, for instance a screw, a nut or similar, the torsion body in the region of said second end being co-rotatively connected to a socket- or ring-like part that is rotatable relative to the handle part when said body is submitted to torsion due to it being loaded with a torque.

BACKGROUND OF THE INVENTION AND PRIOR ART

In order to obtain reliable screw joints, it is important that the screw or nut in question is tightened with an optimal torque, i.e., a torque that is neither too large, nor too small. In practice, dynamometric wrenches of simple, as well as sophisticated, costly designs are used for this purpose. To the latter group belong such dynamometric wrenches that are adjusted to a preset torque value and give off a signal to the operator when this value has been attained, e.g. a sound or light signal. Not seldom, two tools are used for applying the screw element, more specifically on one hand a screw wrench or a straight socket wrench in order to first slightly tighten the screw element, and on the other hand a dynamometric wrench for the final tightening of the screw element. For the latter purpose also combination tools exist. In this case, a release mechanism is included in the tool shaft, which mechanism mostly consists of a spring-activated locking sphere that is located in a groove in a wrench rod mounted in bearings in the tool shaft. The disadvantage of the latter tool is that high precision is required for the involved parts and that these are well greased and protected against intruding impurities. An alternative design is to detect the actual torque by a sensor, for instance in the form of a strain gauge or a piezo-electric sensor. However, all of these alternative problem solutions make the tools expensive and in need of frequent calibrations.

Beside the sophisticated and costly tools, also a number of simpler and cheaper dynamometric wrenches exist. Thus, in U.S. Pat. No. 4,838,134 a dynamometric wrench is disclosed of the type as defined in the preamble of claim 1, according to which the torque may be read by means of a scale. More specifically, in FIGS. 7 and 8 of said document a dynamometric wrench is shown comprising a torsion body in the shape of an elongated hexagonal bar one end of which is inserted into and is co-rotatively connected with a handle portion and which in the region of its opposite end is cc-rotatively connected with a socket having a ring-shaped flange at its end turned towards the handle portion, on which flange a scale is applied which cooperates with a point-shaped indicating hand on the handle portion. When the bar is submitted to torsion, the applied torque may be read on the scale. However, a disadvantage of this known tool is that the operator is left to visually read the torque in question on the scale. This implies that if the operator is inattentive or forced to work under difficult external conditions, for instance in narrow spaces, then he may easily happen to tighten the screw element with an erroneous, i.e. not optimal torque, either it being too small or too large. In the latter case, the tightening may even be accomplished to such an extent that the screw element is destroyed and/or the hexagon bar is sheared into the region of plastic deformation, i.e., the bar is submitted to such a large torque that it is distorted and permanently deformed. In such cases, the tool looses any ability to precisely indicate moments and in practice becomes unusable.

OBJECTS AND FEATURES OF THE INVENTION

The present invention aims at removing the above-mentioned shortcomings of the dynamometric wrench according to U.S. Pat. No. 4,838,134 and provide a simple and low-priced dynamometric wrench which in a reliable way makes possible the application of an optimal torque upon the screw element in question also under difficult external conditions. Thus, a primary object of the invention is to provide a dynamometric wrench which does not necessarily require visual supervision for determining the optimal torque and which guarantees that the required distortion of the torsion body from a shear-free state to the state in which the body applies to the screw element the optimal torque, normally takes place within the elastic region. In other words, after having terminated the transfer of torque, the torsion body shall be able to return to its initial, shear-free state without any plastic, remaining deformation. A further object of the invention is to provide a dynamometric wrench which in a simple way may be reset for transferring differently large, optimal torques. In other words, it shall be possible to use one and the same dynamometric wrench for tightening different types of screws and nuts by torques which are optimal for both types. Still another object of the invention is to create a dynamometric wrench whose torsion body may be applied on the most differing types of screw elements, for instance screws, which have heads with varying female grips, all from a simple screw driver slot to hexagon holes and so called Phillips grips. Yet another object of the invention is to provide a dynamometric wrench that may be produced of simple and inexpensive components, of which at least some are commercially available; all with the object of providing a tool which in its entirety is cheap to manufacture. Furthermore, the dynamometric wrench shall be easy and handy to handle when used.

According to the invention, at least the primary object is attained by the features as defined in the characterizing clause of claim 1. Further, preferred embodiments of the invention are defined in the dependent claims.

BRIEF DESCRIPTION OF THE APPENDED DRAWINGS

In the drawings

FIG. 1 is a side view of a first embodiment of a dynamometric wrench according to the invention, FIG. 2 is a longitudinal section through the dynamometric wrench according to FIG. 1, FIG. 3 is an enlarged end view of a ring portion comprised by the wrench according to FIGS. 1 and 2, FIG. 4 is a vertical section through the ring portion according to FIG. 3, FIG. 5 is a longitudinal section through a modified embodiment of a dynamometric wrench according to the invention, FIG. 6 is an end view of a detachable attachment unit comprised by a special embodiment of the invention, FIG. 7 is a side view of the attachment unit according to FIG. 6, FIG. 8 is a side view of a further embodiment of the dynamometric wrench according to the invention, FIGS. 9 and 10 are a side view and a longitudinal section, respectively, through still another embodiment according to the invention, FIG. 11 is a side view of a fifth variant of the dynamometric wrench according to the invention, and FIG. 12 is a longitudinal section through a sixth variant.

DETAILED DESCRIPTION OF THE PREFERRED EMBODIMENTS OF THE INVENTION

Figure 1:
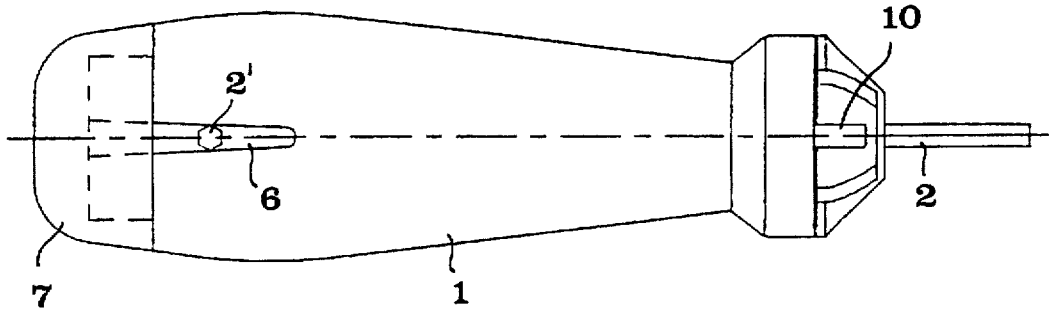
Figure 2:
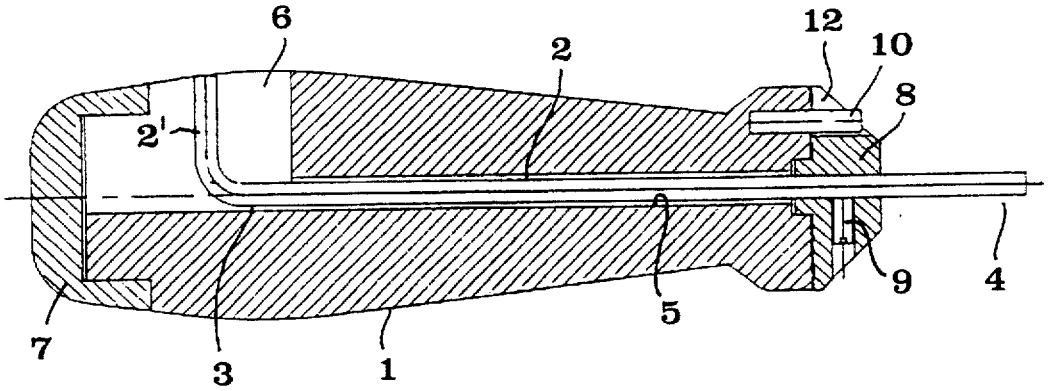
Figure 4:
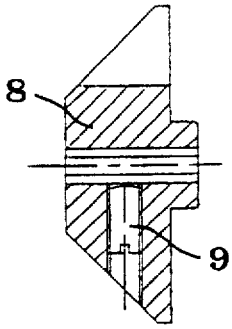
Figure 3:
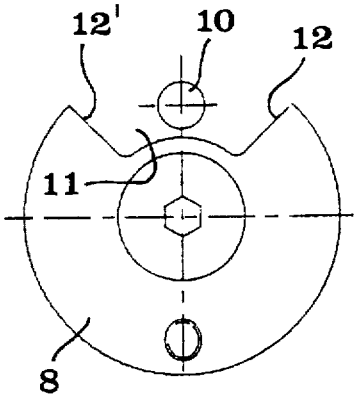

In FIGS. 1 and 2, reference numeral 1 generally designates a manually grippable, handle-forming part, while 2 generally designates an elongated torsion body which has first and second, opposite ends 3 and 4, respectively. In practice, this torsion body may advantageously constitute a part of a so called hexagon key of a commercially available type known per se. More specifically, the torsion body 2 is formed by the long leg of the hexagon key, which leg at the end 3 changes into a perpendicularly protruding, short leg 2'. At its first end 3, i.e. in the region of the short leg 2', the torsion body 2 is co-rotatively connected with the handle part 1. According to the embodiment shown in FIGS. 1 and 2, this has been realized by inserting the hexagon key into a central through-hole or course 5 in the handle portion 1. This hole changes into a groove 6 that opens towards the side, the short leg 2' being accommodated in this groove. The groove 6 is covered by an end cap 7 and is advantageously of a tapering shape (see FIG. 1) in order to permit a wedging-up of key legs of different dimensions. In the region of its outer free end, the leg 2 is co-rotatively connected with a ring-shaped part 8 (see also FIGS. 3 and 4) having a hole the cross-sectional shape of which corresponds to the cross-sectional shape of leg 2. The ring part 8 is anchored at the leg 2 by means of a radial locking screw 9. From the end of handle part 1 a cylindrical pin 10 protrudes that serves as a stop element. As may be clearly seen in FIG. 3, a peripherical countersink or recess 11 is provided in the ring part 8, which countersink or recess is delimited by two surfaces 12, 12' that form shoulders against which the stop element 10 may by brought into abutment. In FIG. 3 the dynamometric wrench is shown in a shear-free state, i.e. in a state in which no torque has been applied upon the leg or body 2. In this state, the stop element 10 is in a neutral position about half-way between the shoulders 12, 12'.

The described dynamometric wrench operates in the following way. The free protruding end portion 4 of leg 2 is moved into engagement with the screwable element in question, in particular the head of a hexagon screw, whereafter a torque is applied upon the handle part 1 by one hand of the operator. As the torque increases with increased tightening of the screw, the leg will be distorted or submitted to torsion in the region between the free end portion 4 and the first end portion 3 that is co-rotatively connected with the handle part. Thereby, the pin 10 serving as a stop element will—depending upon whether the screw is left- or right-threaded—approximate either the one or the other of the two shoulders 12, 12'. When the pin hits the shoulder in question, then the intended, optimal tightening moment has been attained. The size of countersink 11, and thereby the distance between each shoulder and the pin 10, when it is in the neutral position, may be determined at the manufacturing so that the the optimal torque is obtained when the pin hits the shoulder. For a certain, desired torque at a certain free torsion length between the two end portions 3, 4 of the torsion body, the torsion angle is chosen in a suitable way, i.e. the angle that the pin 10 shall move from the neutral position to a position in which it abuts against a shoulder. The relation between these parameters may be easily calculated by the constructor. Normally, the tool works within the purely elastic region of the material in the hexagon key 2, which inter alia implies that the repetition accuracy of the obtained, optimal torque becomes very high. At a possible excess of the optimal or maximal moment, then the "over-moment" will be taken up via the pin 10 and the shoulder 12, 12' in question. This is not only true for the tightening of a screw but also for the untightening of the same, for instance in the case when the screw binds. However, would perchance in connection therewith a plastic distortion arise of the free end portion 4 of the leg 2, this does not influence the repetition accuracy, in that the stop pin 10 returns to its neutral position after an accomplished transfer of torque, about half-way between the two shoulders 12, 12'.

The advantages of the dynamometric wrench according to the invention are—besides it being mechanically simple and comprising few and inexpensive components—that the torque is only dependent upon the hexagon key 2 as a torsion body and that the dynamometric wrench does not have any mechanical element that may cause any friction forces which may influence the accuracy. In the proximity of the maximal or optimal tightening moment, in practice the hand that holds the tool trembles. This trembling makes that the operator relatively easily feels in the handle part when the pin or stop element hits the shoulder surface in question. When sc desired, the contact between the pin and the shoulder surface may also be noted visually.

Figure 5:
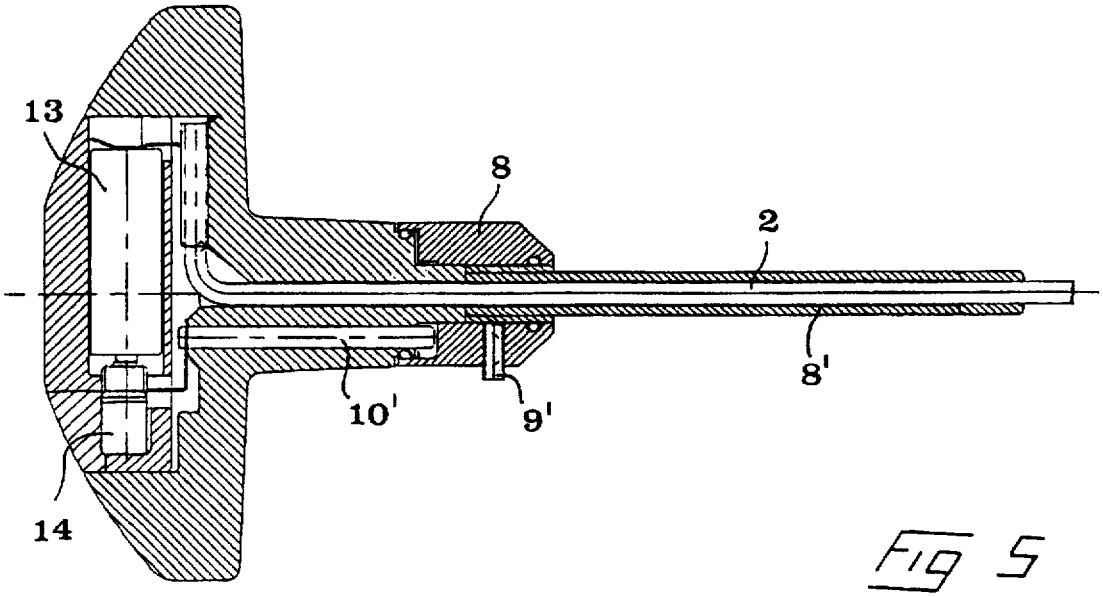

In the cases where the dependence on very exact final tightening moments is large, the detecting of the contact between the pin 10 serving as a stop element and the shoulder or limitation surface may be made electrically. In FIG. 5 such a modified embodiment is shown, according to which a battery 13 is connected to an extended pin 10' and to an indication element 14, for instance in the form of a lamp, a light emitting diode or a sound relay. When the pin 10' is in contact with the shoulder in question, then the indication element 14 is activated and gives off a signal when the desired torque has been attained. In the case when the indication element is a lamp or a light emitting diode, then this element shall be included into a cap of a transparent nature. According to the example shown in FIG. 5, the ring part 8 is connected with a sleeve or sleeve-like part 8' which in turn is co-rotatively connected with the torsion body 2 in the region of its free end. Advantageously, the ring part 8 is positionable in different positions relative to the sleeve part 8' in order to obtain differently large optimal torques. A locking of the parts relative to each other is made by means of a locking screw 9'.

Figure 6:
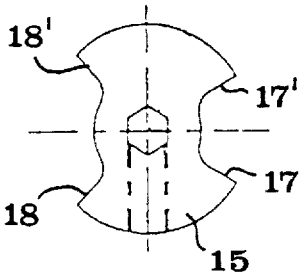
Figure 7:
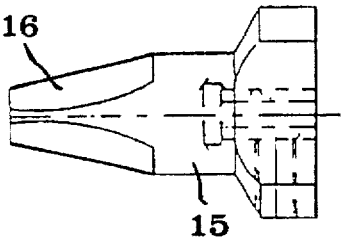

In FIGS. 6 and 7 a body 15 is illustrated that is made in the form of a separate attachment unit which may replace the previously described ring part 8 and be co-rotatively connected with the torsion body 2, more specifically by the free end of the torsion body being introduced into a corresponding hole in the attachment body and the latter being secured to the torsion body, for instance by a locking screw of the sort previously referred to. The attachment body 15 has a carrier means 16 for the application in screw elements with another female grip than just a hexagon hole. More specifically, the carrier means 16 have the form of wings suited to being introduced into a so called Phillips-shaped grip in, for instance, the head of a screw. Further, in this case the attachment body is formed with two pairs of shoulders 17, 17' and 18, 18', respectively, in connection with countersinks or recesses with different peripheral lengths. Thus, the distance between the shoulder surfaces 17, 17' is shorter than the distance between the shoulder surfaces 18, 18'. By mounting the attachment body 15 on the torsion body 2 in one of two diametrically opposed mounting positions, the stop element or pin in question may be brought to cooperate with either the one or the other pair of shoulder surfaces 17, 17' and 18, 18', respectively. In this way, the attachment body may be used for two different, optimal torques, i.e. for the tightening of the screw element with different torques which in both cases are optimal.

Figure 8:
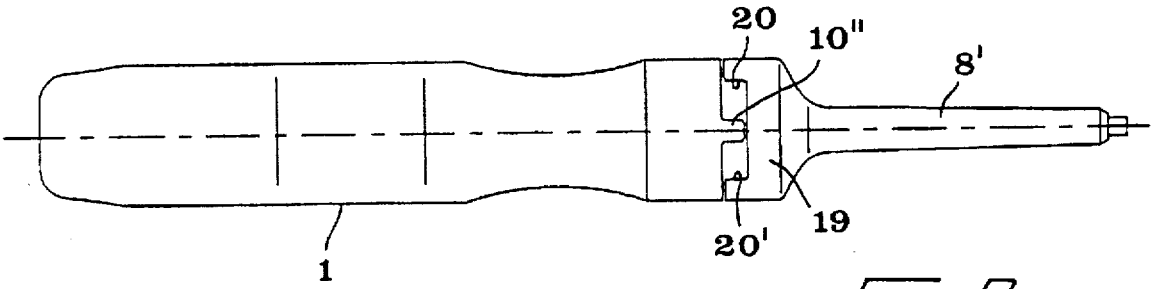

In FIG. 8 an embodiment is shown according to which the handle portion 1 of the tool—in agreement with the embodiment of FIGS. 1 and 2—has the general form that is characteristic for a conventional screw driver. Instead of an axially short ring part, in this case a comparatively long, socket-like part 8' is used, which in the region of its end being turned towards the handle part 1 is widened into a cap-like portion 19. In this cap portion, at least one countersink is provided whose ends are delimited by shoulder surfaces 20, 20'. In this case, an axially as well as radially protruding protrusion on the handle part 1 serves as a stop element 10".

Figure 9:
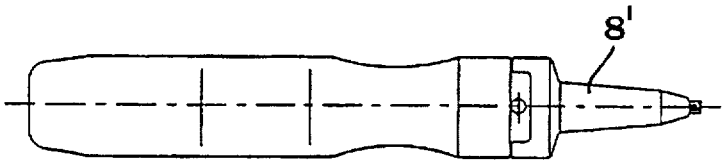
Figure 10:
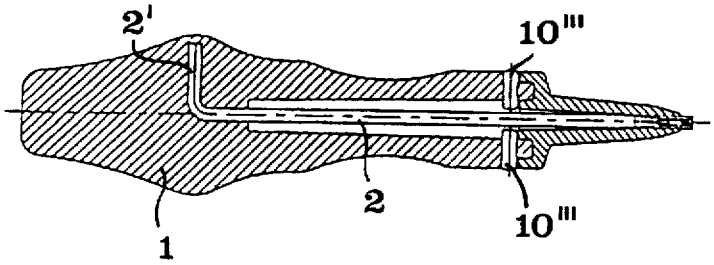

In FIGS. 9 and 10 a similar screw driver-like embodiment is illustrated according to which, however, the stop element consists of two radially directed, diametrically opposed taps 10"' which engage into separate countersinks in the socket part 8'. In FIG. 10 it should in particular be noted that the hexagon key serving as a torsion body is with its short leg 2' cast into the material, in particular plastic, which forms the handle part 1.

Figure 11:
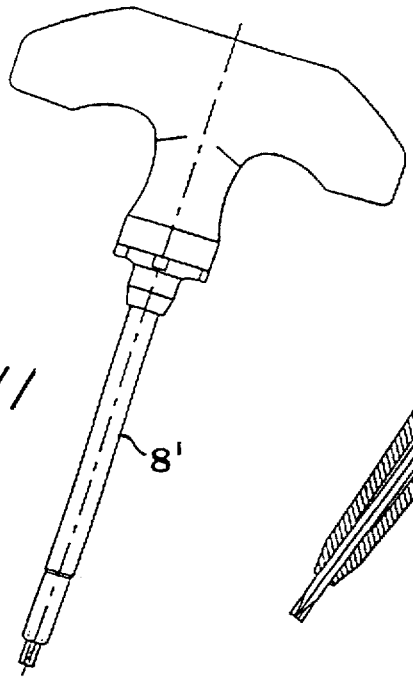
Figure 12:
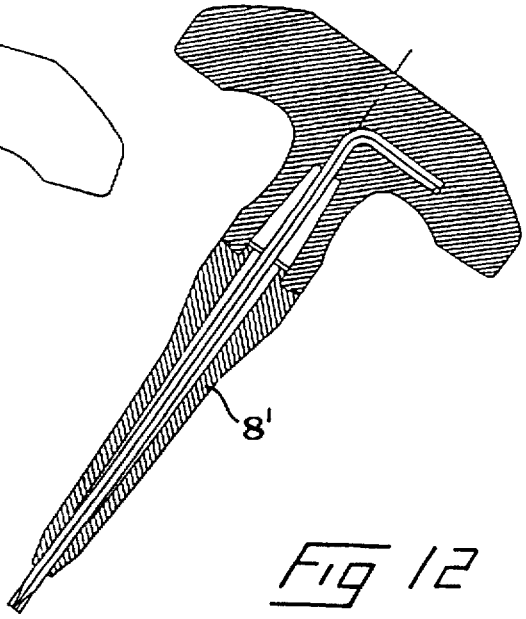

Eventually, in FIGS. 11 and 12 two embodiments of dynamometric wrenches are shown whose handle parts are T-formed. In both cases the keys comprise elongated socket parts 8' whose free ends are co-rotatively connected in a suitable way with the torsion body in question in the region of the end that is intended to be engaged with the screw element in question.

Feasible Modifications of the Invention

It is evident that the invention is not restricted merely to the embodiments described and shown in the drawings. Thus, it is for example possible to form the socket or ring part of the tool with only one shoulder for cooperation with the stop element, instead of one or more pairs of shoulders. However, the latter embodiment is preferred. Furthermore, it should be emphasized that in practice the tool according to the invention may be adjusted to the most differing screw elements, either by directly conferring to the free end of the torsion body as such a form that makes possible an adequate application upon the screw element in question, or by providing the tool with one or more adapter-like attachment units which make possible the application of one and the same tool for many different types of screw elements.

I claim:

1. A dynamometric wrench comprising a manually grippable, handle-forming part (1) and an elongated torsion body (2), which in the region of a first end (3) of said body is co-rotatively connected with the handle part (1) and in the region of an opposed, second end (4) of said body has means for joining the torsion body to a screwable element, the torsion body in the region of said second end (4) being co-rotatively connected to a rotatable part (8, 8', 15) that is rotatable relative to the handle part when said body is submitted to torsion due to it being loaded with a torque, characterized in that at least one stop element (10, 10', 10", 10"') is connected with one of said handle part and rotatable part (1; 8, 8', 15, said stop element being arranged to cooperate with at least one shoulder (12, 12'; 17, 17'; 18, 18'; 20, 20') on the of said handle part and rotatable part such that the stop element is brought into contact with the shoulder when the screw element has been submitted to a predetermined, optimal torque that gives an elastic, but not a plastic distortion to the torsion body.

2. Dynamometric wrench according to claim 1, characterized in that the stop element (10) is placed between and arranged to cooperate with a pair of separate shoulders (12, 12'; 17, 17'; 18, 18'; 20, 20'), the stop element, when in a neutral position, in which the torsion body (2) is free from shear, being positioned about half-way between the two shoulders.

3. Dynamometric wrench according to claim 2, characterized in that the shoulder-carrying part (15) comprises at least two pairs of shoulders (17, 17'; 18, 18') with which the stop element (10) may selectively cooperate, the shoulders in the different pairs being positioned at differently large distances from each other in order to make possible a variation of the torque to be applied upon the screw element.

4. Dynamometric wrench according to claim 3, characterized in that the pairs of shoulders (17, 17', 18, 18') differently distanced from each other are provided on an attachment body (15) that is detachably applicable on and co-rotatively connectable with the torsion body (2), which attachment body has carrier means (16) for engagement with screw elements.

5. Dynamometric wrench according to claim 1, characterized in that the torsion body (2) constitutes a part of an L-formed hexagon key having differently long legs (2, 2'), which is provided within the torsion body with its short leg (2') in the handle part (1), this short leg (2') securing the co-rotative connection with the handle part.

6. Dynamometric wrench according to claim 2, characterized in that the torsion body (2) constitutes a part of an L-formed hexagon key having differently long legs (2, 2') which is provided within the torsion body with its short leg (2') in the handle part (1), this short leg (2') securing the co-rotative connection with the handle part.

7. Dynamometric wrench according to claim 3, characterized in that the torsion body (2) constitutes a part of an L-formed hexagon key having differently long legs (2, 2') which is provided within the torsion body with its short leg (2') in the handle part (1), this short leg (2' ) securing the co-rotative connection with the handle part.

8. Dynamometric wrench according to claim 4, characterized in that the torsion body (2) constitutes a part of an L-formed hexagon key having differently long legs (2, 2'), which is provided within the torsion body with its short leg (2') in the handle part (1), this short leg (2') securing the co-rotative connection with the handle part.

9. Dynamometric wrench according to claim 1, further comprising an electrical circuit including an indication element and a source of power, said stop element being moveable into and out of contact with said circuit to close and open said circuit, respectively, said stop element closing said circuit and actuating said indication element in a first mode when said stop element is brought into contact with said shoulder, and opening said circuit and deactivating said indication element in a second mode when said stop element is brought out of contact with said shoulder.

10. Dynamometric wrench according to claim 2, further comprising an electrical circuit including an indication element and a source of power, said stop element being moveable into and out of contact with said circuit to close and open said circuit, respectively, said stop element closing said circuit and actuating said indication element in a first mode when said stop element is brought into contact with said shoulder, and opening said circuit and deactivating said indication element in a second mode when said stop element is brought out of contact with said shoulder.

11. Dynamometric wrench according to claim 3, further comprising an electrical circuit including an indication element and a source of power, said stop element being moveable into and out of contact with said circuit to close and open said circuit, respectively, said stop element closing said circuit and actuating said indication element in a first mode when said stop element is brought into contact with said shoulder, and opening said circuit and deactivating said indication element in a second mode when said stop element is brought out of contact with said shoulder.

12. Dynamometric wrench according to claim 4, further comprising an electrical circuit including an indication element and a source of power, said stop element being moveable into and out of contact with said circuit to close and open said circuit, respectively, said stop element closing said circuit and actuating said indication element in a first mode when said stop element is brought into contact with said shoulder, and opening said circuit and deactivating said indication element in a second mode when said stop element is brought out of contact with said shoulder.

13. Dynamometric wrench according to claim 9, characterized in that the torsion body (2) constitutes a part of an L-formed hexagon key having differently long legs (2, 2') which is provided within the torsion body with its short leg (2') in the handle part (1), this short leg (2') securing the co-rotative connection with the handle part.

14. Dynamometric wrench according to claim 10, characterized in that the torsion body (2) constitutes a part of an L-formed hexagon key having differently long legs (2, 2') which is provided within the torsion body with its short leg (2') in the handle part (1), this short leg (2') securing the co-rotative connection with the handle part.

15. Dynamometric wrench according to claim 11, characterized in that the torsion body (2) constitutes a part of an L-formed hexagon key having differently long legs (2, 2') which is provided within the torsion body with its short leg (2' ) in the handle part (1), this short leg (2') securing the co-rotative connection with the handle part.

16. Dynamometric wrench according to claim 12, characterized in that the torsion body (2) constitutes a part of an L-formed hexagon key having differently long legs (2, 2') which is provided within the torsion body with its short leg (2') in the handle part (1), this short leg (2') securing the co-rotative connection with the handle part.

* * * * *